US008449107B2

(12) United States Patent
Kawabata et al.

(10) Patent No.: US 8,449,107 B2
(45) Date of Patent: May 28, 2013

(54) RECORDING APPARATUS

(75) Inventors: Seiji Kawabata, Nagano-ken (JP); Katsuyuki Kondo, Nagano-ken (JP); Sanshiro Takeshita, Nagano-ken (JP); Shintaro Komuro, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/248,531

(22) Filed: Sep. 29, 2011

(65) Prior Publication Data

US 2012/0081490 A1 Apr. 5, 2012

(30) Foreign Application Priority Data

Oct. 4, 2010 (JP) ..... 2010-225027
Oct. 4, 2010 (JP) ..... 2010-225040

(51) Int. Cl.
*B41J 2/01* (2006.01)

(52) U.S. Cl.
USPC ..... 347/104; 347/101

(58) Field of Classification Search
USPC ..... 347/104, 101, 16
See application file for complete search history.

(56) References Cited

U.S. PATENT DOCUMENTS

| | | | | |
|---|---|---|---|---|
| 3,673,603 | A * | 6/1972 | Brock | 346/139 R |
| 4,667,947 | A * | 5/1987 | Costa et al. | 271/9.12 |
| 4,688,957 | A * | 8/1987 | Prevignano | 400/605 |
| 4,828,416 | A * | 5/1989 | Pensavecchia et al. | 400/624 |
| 5,248,210 | A * | 9/1993 | Schulz | 400/625 |
| 5,727,725 | A * | 3/1998 | Paskvich | 226/200 |
| 6,848,850 | B2 | 2/2005 | Matsuo et al. | |
| 6,883,987 | B2 * | 4/2005 | Kamin et al. | 400/605 |
| 6,953,739 | B2 * | 10/2005 | Yang et al. | 438/488 |
| 7,021,755 | B2 * | 4/2006 | Ogura et al. | 347/104 |
| 7,085,513 | B2 * | 8/2006 | Kim et al. | 399/98 |
| 7,100,914 | B2 * | 9/2006 | Ramos | 271/121 |
| 7,140,796 | B2 | 11/2006 | Matsuo et al. | |
| 7,195,411 | B2 | 3/2007 | Matsuo et al. | |
| 7,800,788 | B2 | 9/2010 | Yazawa et al. | |
| 8,020,853 | B2 * | 9/2011 | Shiraki et al. | 271/127 |
| 2005/0156372 | A1 * | 7/2005 | Ramos | 271/121 |

FOREIGN PATENT DOCUMENTS

| | | |
|---|---|---|
| JP | 2003-127484 | 5/2003 |
| JP | 2006-205630 | 8/2006 |

* cited by examiner

*Primary Examiner* — Stephen Meier
*Assistant Examiner* — Leonard S Liang

(57) ABSTRACT

A recording apparatus according to the invention includes an ink jet recording head that records onto a recording medium; a paper cassette that holds the recording medium in alignment with the vertical direction; an inverting path unit that inverts the transport direction of the recording medium fed out from the paper cassette; and a downstream-side path unit that transports the recording medium from the inverting path unit toward the paper cassette.

7 Claims, 9 Drawing Sheets

RECORDING APPARATUS

CROSS-REFERENCE TO RELATED APPLICATIONS

Priority is claimed under 35 U.S.C. §119 to Japanese Application Nos. 2010-225040 filed on Oct. 4, 2010 and 2010-225027 filed on Oct. 4, 2010, which are hereby incorporated by reference in their entirety.

BACKGROUND

1. Technical Field

The present invention relates to recording apparatuses that record onto a recording medium, and particularly relates to recording apparatuses that include a recording medium transport path in which the recording medium is supplied from a recording medium holding unit, is bent and has its transport direction inverted by an inverting path unit, and is transported toward the top of the apparatus.

2. Related Art

Recording apparatuses such as facsimile devices, printers, and so on employ various types of paper transport paths. Of these, some apparatuses include an approximately U-shaped paper transport path, where the paper is supplied, from a paper cassette that holds the paper, in the vertical direction toward the bottom of the apparatus, has its transport direction inverted by an inverting path unit, and is then transported toward the top of the apparatus.

The recording apparatus disclosed in JP-A-2006-205630 is a recording apparatus configured as what is known as a "standing type", and is a recording apparatus configured so that paper that is housed vertically is supplied toward the bottom of the apparatus, recording is carried out while inverting the paper using an inversion unit in a lower area of the apparatus, and the paper is then transported back toward the top of the apparatus.

As described above, a recording apparatus that includes an approximately U-shaped paper transport path, in which paper is supplied toward the bottom of the apparatus from a paper cassette, the transport direction of the paper is inverted by an inverting path unit, and the paper is then transported toward the top of the apparatus, can be configured as a standing type, and can therefore achieve a smaller footprint when installed. However, when attempting to configure an apparatus as a standing type in this manner, it is necessary to take pains to dispose the constituent elements in a manner that avoids increasing the dimensions of the apparatus in the planar direction (for the sake of simplicity, this will be referred to as the "thickness direction" hereinafter).

For example, if a carriage including an ink jet recording head is provided, there is the risk that the thickness direction dimension of the apparatus will increase, and it is necessary to avoid this risk.

In addition, because the paper that has been recorded onto is discharged toward the top of the apparatus, there is also a problem in that the attitude of the discharged paper will be unstable (that is, will flop).

SUMMARY

An advantage of some aspects of the invention is to provide a recording apparatus, including a recording medium transport path that supplies a recording medium from a recording medium holding unit to an inverting path unit, inverts the transport direction using the inverting path unit, and transports the recording medium toward the top of the apparatus, that avoids an increase in the thickness direction dimension of the apparatus while stabilizing the attitude of the discharged recording medium.

A recording apparatus according to a first aspect of the invention includes a recording head that records onto a recording medium; a recording medium holding unit that holds the recording medium in alignment with the vertical direction; an inverting path unit that inverts the transport direction of the recording medium fed out from the recording medium holding unit; and a downstream-side path unit that transports the recording medium from the inverting path unit toward the recording medium holding unit.

According to this aspect, the recording medium is discharged toward the recording medium holding unit, and thus the attitude of the recording medium is stabilized.

According to a second aspect of the invention, the recording apparatus of the first aspect further includes a recording medium discharge unit, provided downstream from the recording head in the downstream-side path unit, that discharges the recording medium to the exterior of the apparatus, and the recording medium is discharged by the recording medium discharge unit while sliding along the recording medium holding unit.

According to this aspect of the invention, the recording medium is discharged by the recording medium discharge unit while sliding along the recording medium holding unit, and thus the attitude of the discharged recording medium is stabilized. In addition, the discharged recording medium pushes against the recording media that have already been discharged, and thus the recording media that have already been discharged retain their alignment and are neatly stacked. Furthermore, because part of the recording medium holding unit can be used as a stacker, it is possible to reduce the number of components, which in turn achieves a reduction in the size and the cost of the apparatus.

According to a third aspect of the invention, the recording apparatus according to the second aspect is configured so that, when the recording apparatus is installed, the height direction dimension of the recording apparatus is greater than at least one of the horizontal width direction dimension and the depth direction dimension of the recording apparatus, and the depth direction is smaller than the horizontal width direction dimension; the recording apparatus further includes a discharge port for discharging the recording medium discharged by the recording medium discharge unit to the exterior of the recording apparatus; and the recording medium holding unit and the discharge port are disposed in a position that is apart from the central location in the depth direction.

According to this aspect, the recording medium holding unit and the discharge port are disposed in a position that is apart from the central location in the depth direction; accordingly, it is possible to secure continuous space that is comparatively wide in the top surface of the apparatus, which makes it possible to increase the freedom with which the apparatus can be laid out. In particular, in the case where an operation panel, which is configured of operation switches and the like, is disposed on the top surface of the apparatus, a higher degree of freedom can be ensured for the design thereof.

According to a fourth aspect of the invention, in the recording apparatus according to the first aspect, the inverting path unit switches the transport direction of the recording medium to an upward direction; and at least part of a downstream-side path formed by the downstream-side path unit is tilted toward the recording medium holding unit.

According to this aspect, at least part of the downstream-side path formed by the downstream-side path unit is tilted toward the recording medium holding unit, thus forming an empty space above the downstream-side path; by disposing constituent elements of the recording apparatus in this empty space, an increase in the thickness direction dimension of the apparatus can be avoided. Furthermore, because at least part of the downstream-side path is tilted, the recording medium does not flop over when the recording medium is discharged upward, which makes it possible to stabilize the attitude of the recording medium.

According to a fifth aspect of the invention, in the recording apparatus according to the fourth aspect, a guide member that forms the downstream-side path is formed; the guide member includes a guide surface that guides the recording medium downstream; at least part of the guide surface tilts toward the recording medium holding unit; and the surface of the recording head that records onto the recording medium is provided so as to be aligned with the tilted guide surface.

According to this aspect, the recording apparatus can achieve the same effects as the aforementioned fourth aspect.

According to a sixth aspect of the invention, in the recording apparatus according to the fourth aspect, the height direction dimension of the recording apparatus when the recording apparatus is installed is greater than at least one of the horizontal width direction dimension and the depth direction dimension of the recording apparatus.

According to this aspect, the footprint of the recording apparatus when installed can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
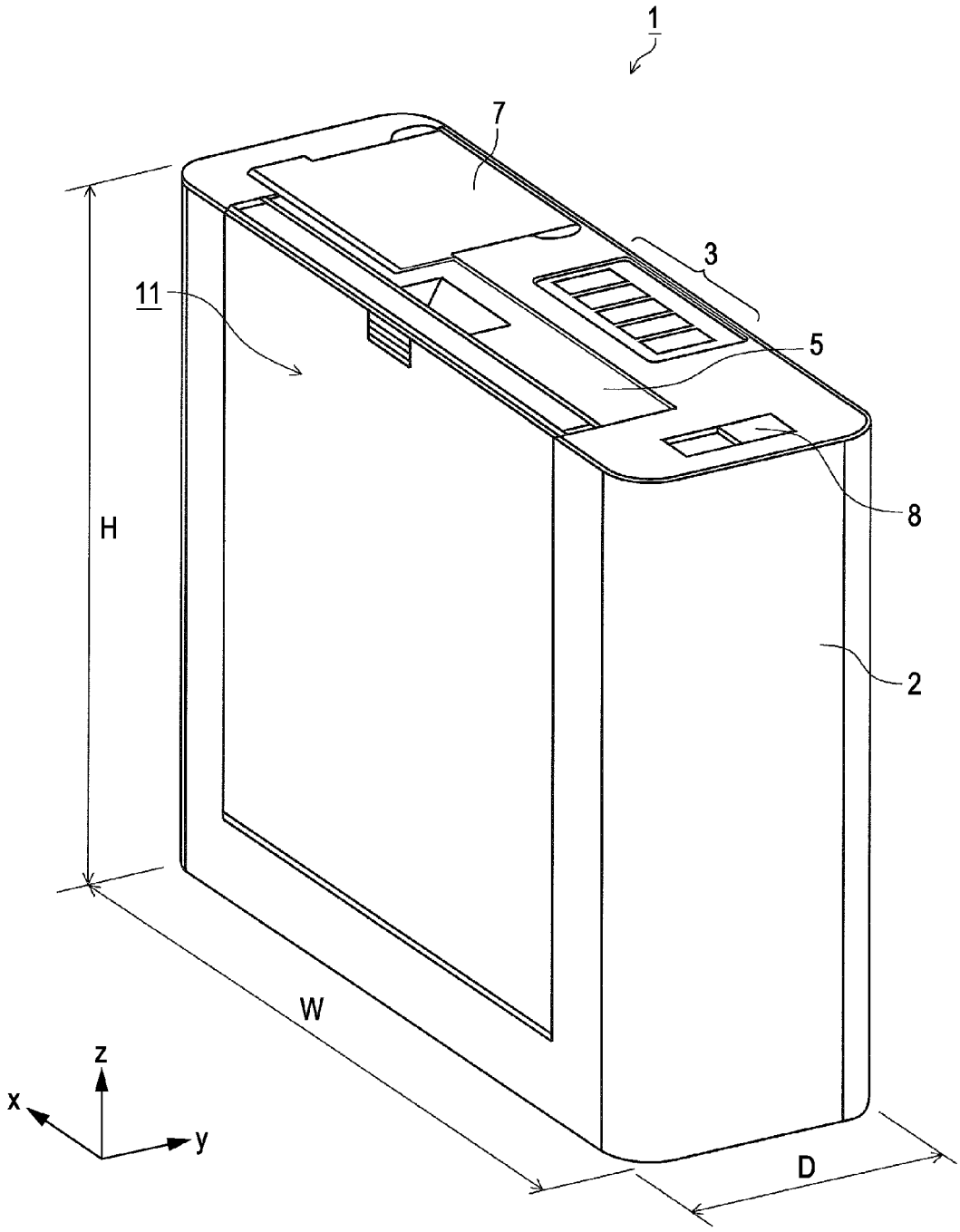
FIG. 1 is an overall external perspective view of an ink jet printer according to the invention.
Figure 2:
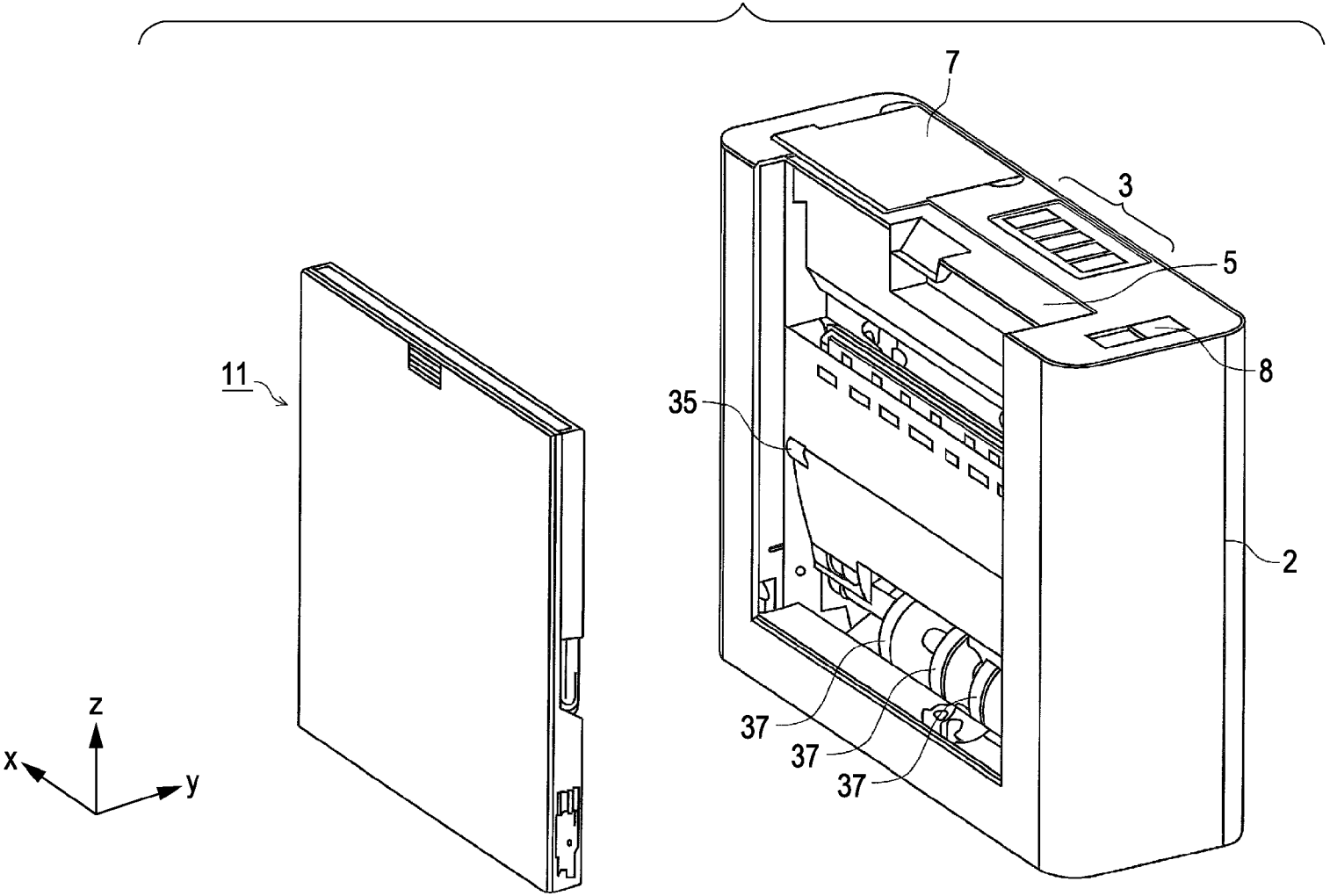
FIG. 2 is an external perspective view of the ink jet printer according to the invention, illustrating a state in which a paper cassette has been removed.
Figure 3:
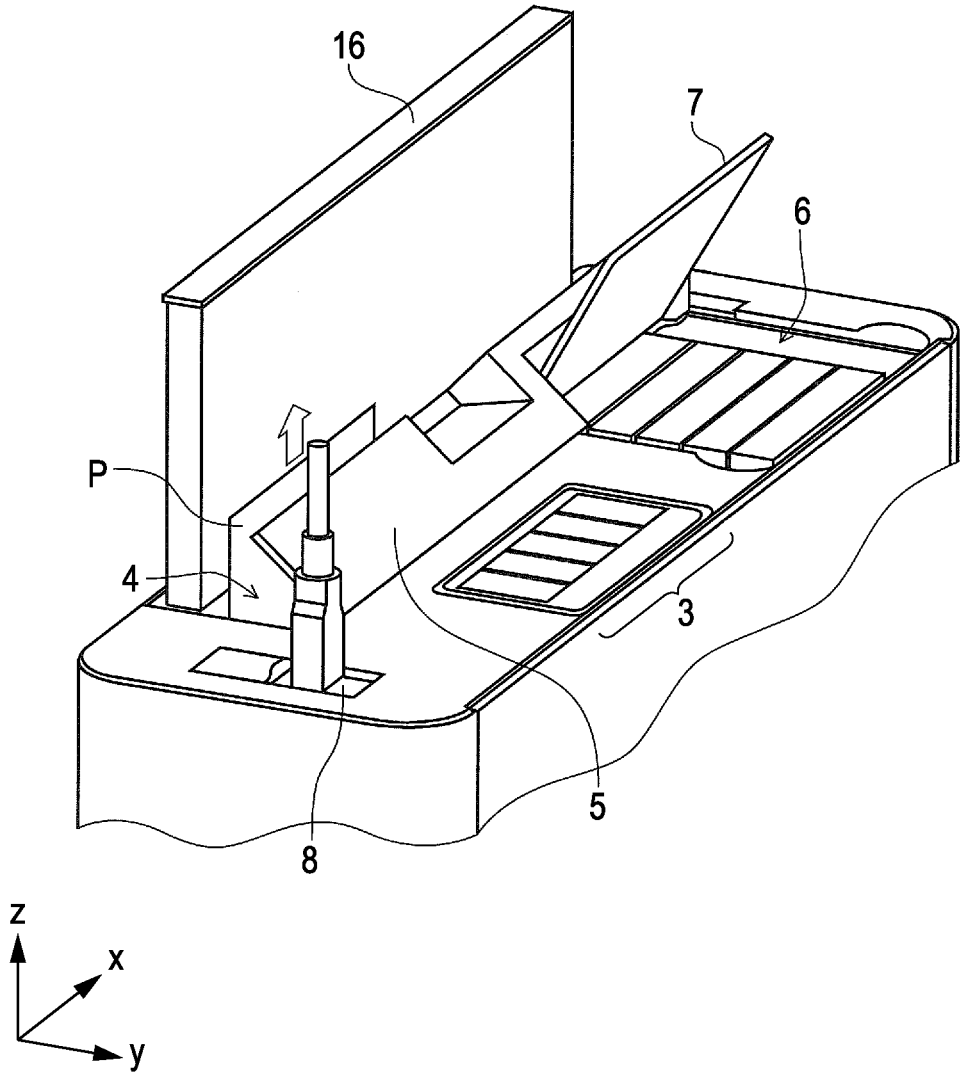
FIG. 3 is an external perspective view of an upper area of the ink jet printer according to the invention.
Figure 4:
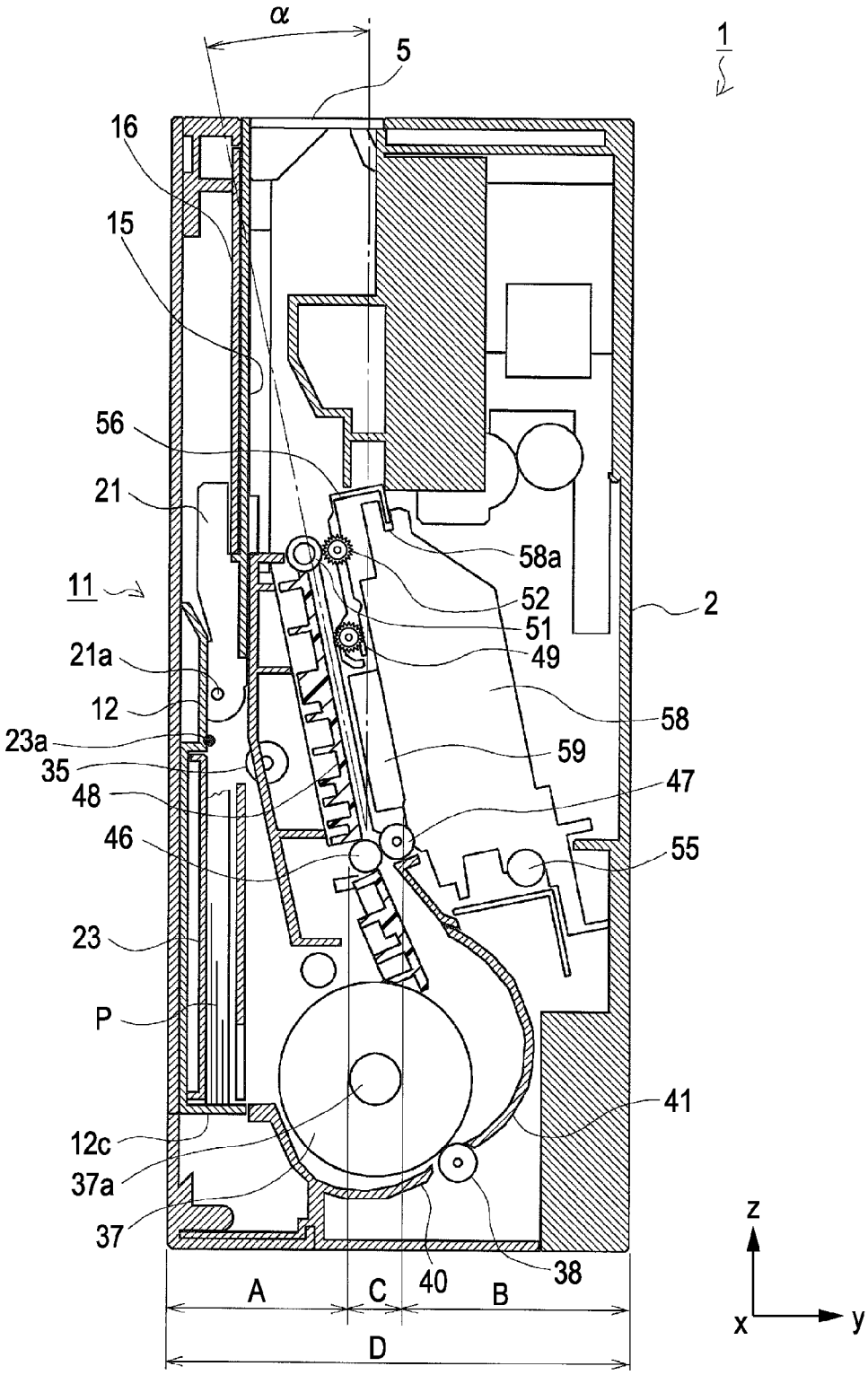
FIG. 4 is a cross-sectional view of the ink jet printer according to the invention, seen from the side.
Figure 5:
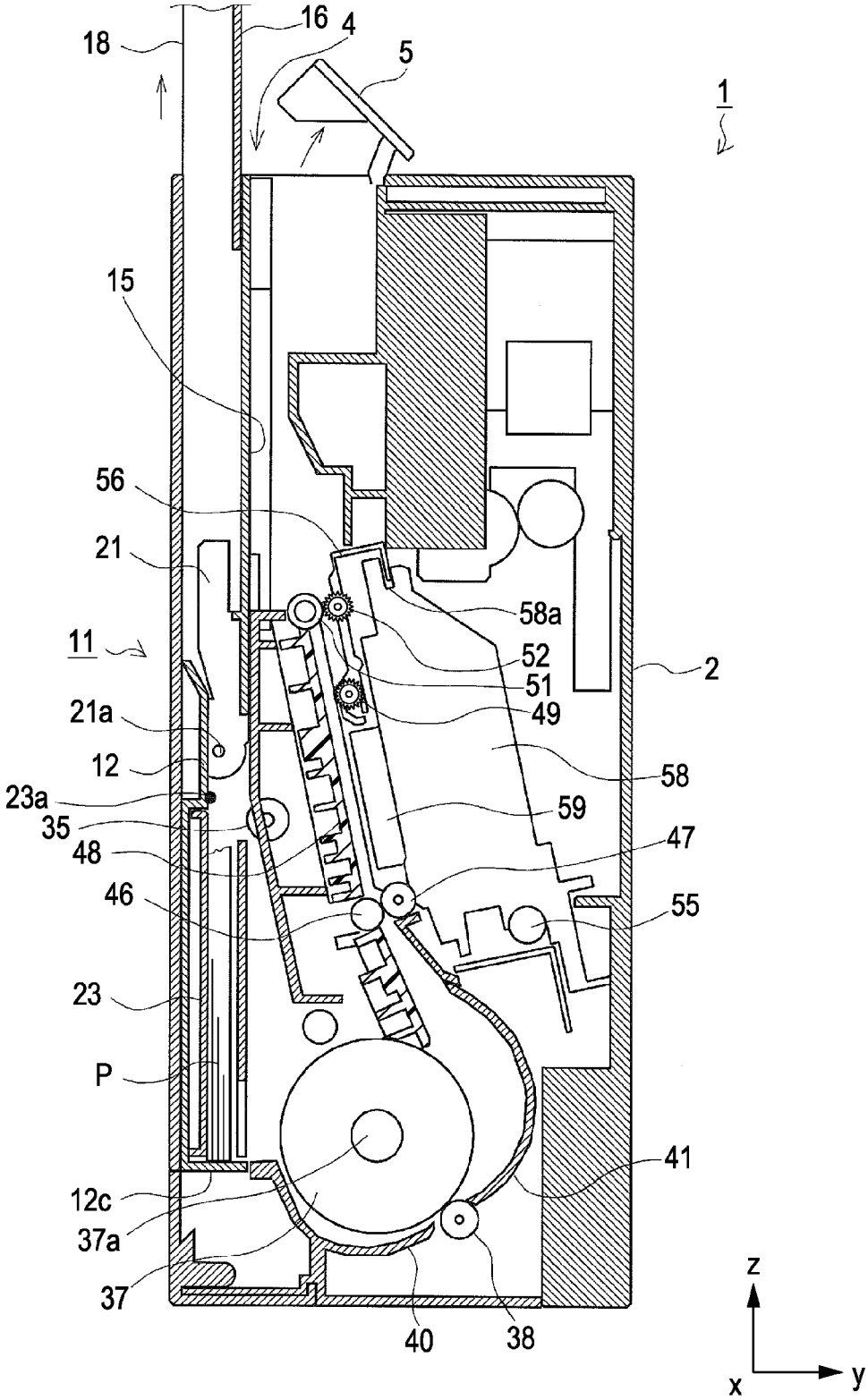
FIG. 5 is a cross-sectional view of the ink jet printer according to the invention, seen from the side.
Figure 6:
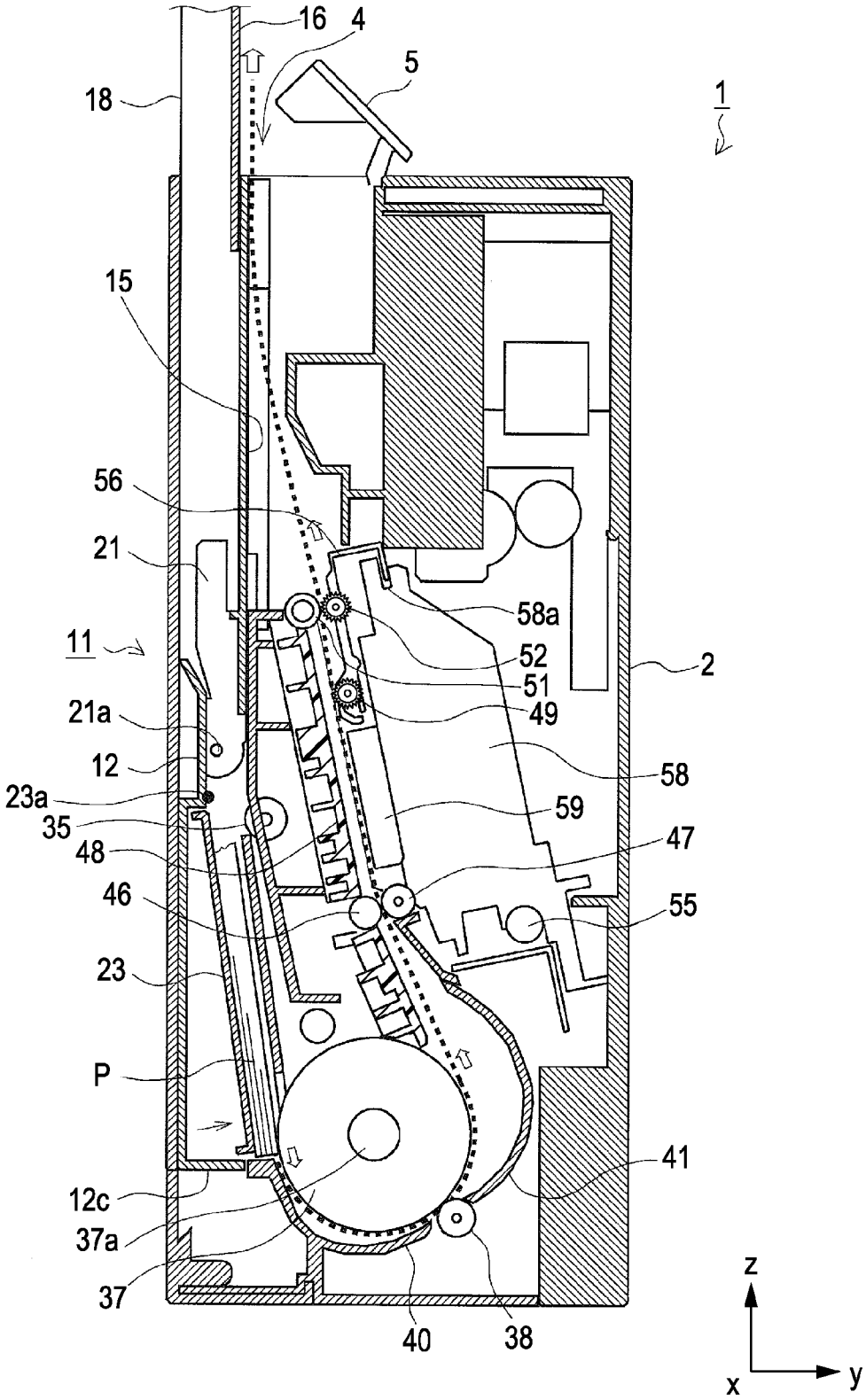
FIG. 6 is a cross-sectional view of the ink jet printer according to the invention, seen from the side.
Figure 7:
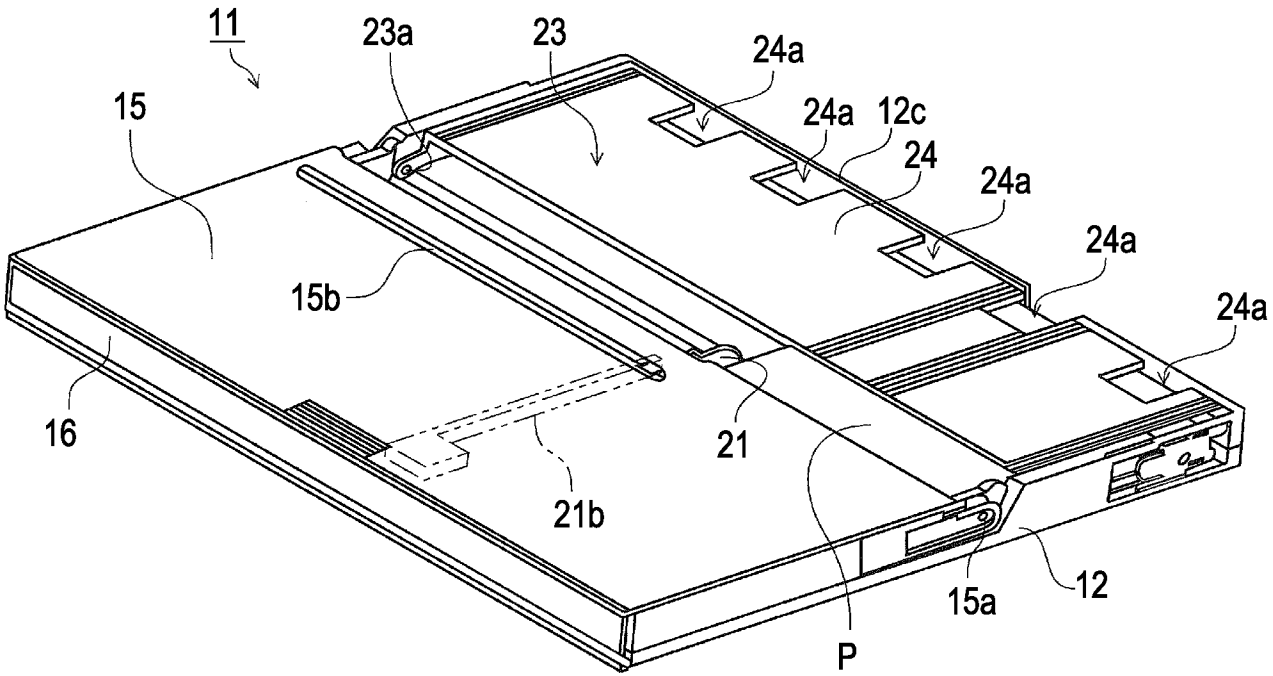
FIG. 7 is an external perspective view illustrating the paper cassette (in a state in which an upper cover is closed).
Figure 8:
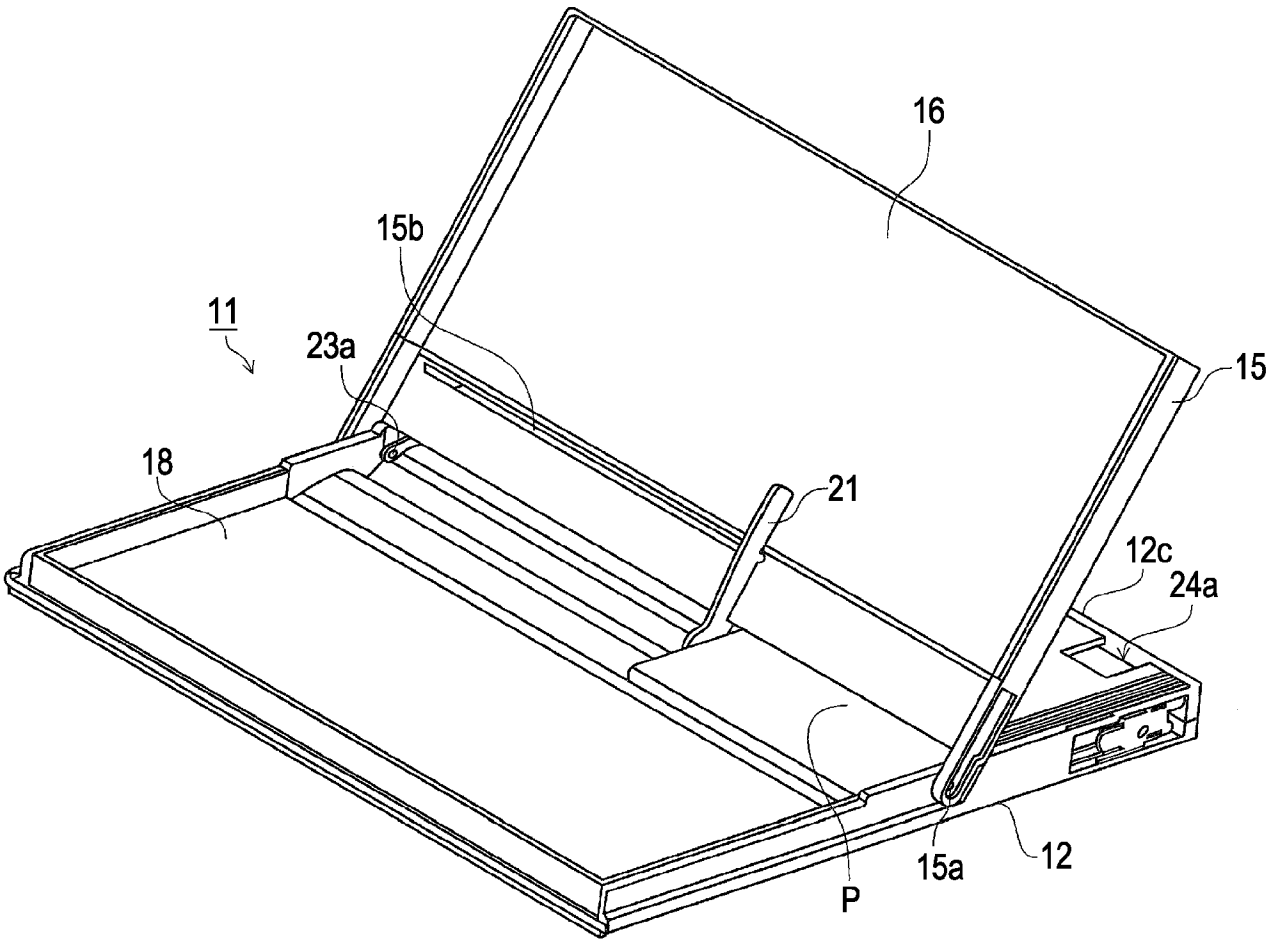
FIG. 8 is an external perspective view illustrating the paper cassette (in a state in which an upper cover is open).
Figure 9A:
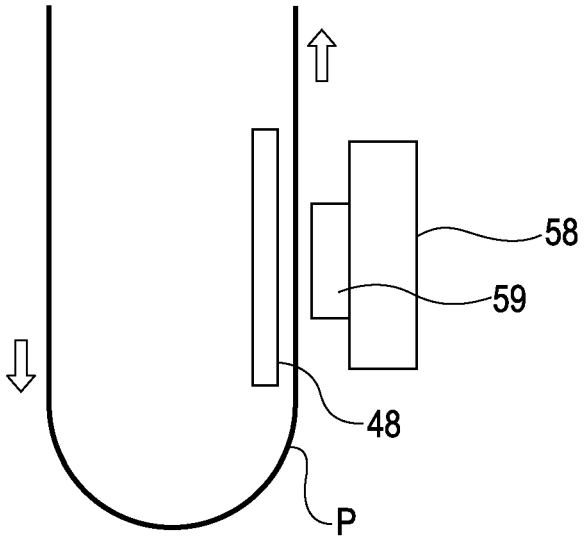
FIGS. 9A and 9B illustrate variations on a paper transport path.
Figure 9B:
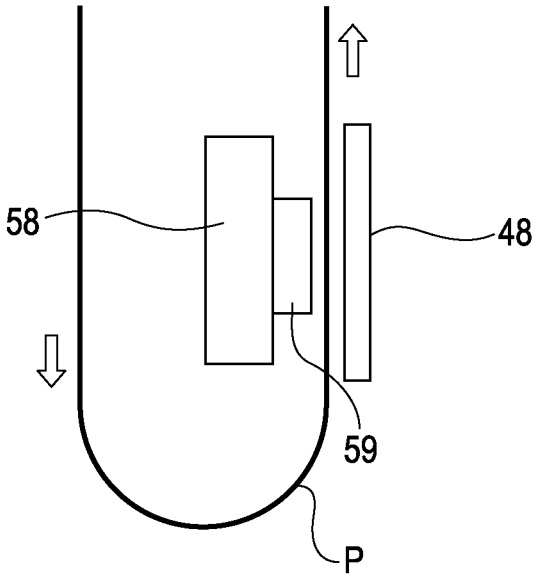

Hereinafter, an ink jet printer embodying a recording apparatus according to the invention will be described with reference to FIG. 1 through FIG. 9B. FIG. 1 is an overall external perspective view of an ink jet printer 1 according to this embodiment; FIG. 2 is an external perspective view illustrating a state in which a paper cassette 11 has been removed; FIG. 3 is an external perspective view illustrating an upper area of the ink jet printer 1; FIGS. 4 through 6 are cross-sectional views of the same, viewed from the side; FIGS. 7 and 8 are external perspective views of a paper cassette 11 (where FIG. 7 illustrates a state in which an upper cover is closed, and FIG. 8 illustrates a state in which the upper cover is open); and FIGS. 9A and 9B illustrate variations on a paper transport path.

In order to illustrate the rollers disposed in the paper transport path of the ink jet printer 1, almost all of the rollers are depicted as being aligned with the same surface in FIGS. 4 through 6; however, it is not necessarily the case that the positions of the rollers in the paper width direction (in FIGS. 4 through 6, the front-back surface direction of the paper) match (although there are some cases where the positions do match). Furthermore, in the x-y-z coordinate system mentioned in the drawings, the x direction corresponds to the horizontal width direction of the apparatus and the paper width direction, the y direction corresponds to the depth direction of the apparatus (this is also called the "thickness direction of the apparatus" in some cases hereinafter), and the z direction corresponds to the height direction of the apparatus (the vertical direction).

1. Overall Configuration of Ink Jet Printer

Hereinafter, the overall configuration of the ink jet printer 1 will be broadly described. The ink jet printer 1 is a standing type ink jet printer in which the height direction dimension of the apparatus is, when the apparatus is installed, greater than at least one of the horizontal width direction dimension and the depth direction dimension of the apparatus; in this embodiment, the configuration is such that the height direction dimension (indicated by the letter H in FIG. 1) is greater than both the horizontal width direction dimension (indicated by the letter W in FIG. 1) and the depth direction dimension (indicated by the letter D in FIG. 1). In addition, in this embodiment, the horizontal width direction dimension W is greater than the depth direction dimension D.

Note that the depth direction (the y direction) and the horizontal width direction (the x direction) are concepts used for the sake of simplicity in this specification; in other words, it is not necessarily the case that the surface in the horizontal width direction (the x direction), whose surface area is large, will face the user when the apparatus is installed, and there are both cases where the surface in the depth direction (the y direction), whose surface area is small, faces the user and in which the apparatus is installed in a slanted direction in which neither of those surfaces face the user. However, regardless of in which direction the apparatus is installed, the height direction (the z direction) is always the direction that follows the vertical direction (the direction of the force of gravity).

The ink jet printer 1 has its exterior configured by a slim-form box-shaped housing 2; an operation panel 3, configured by disposing operation buttons and the like, an interface cable connection unit 8, for connecting interface cables, and so on are provided on the top surface of the apparatus.

In addition, an ink cartridge mounting unit, in which a plurality of ink cartridges 6 are mounted in a removable state, is provided in the upper surface of the apparatus, and reference numeral 7 indicates an ink cartridge cover for opening/closing the ink cartridge mounting unit. The ink cartridge cover 7 is opened/closed by the user when replacing the ink cartridges 6.

Furthermore, a paper discharge port 4 for discharging paper that has been recorded onto is provided in the upper surface of the apparatus, and reference numeral 5 indicates a paper discharge port cover for opening/closing the paper discharge port 4. The paper discharge port cover 5 is configured both so as to be openable/closable by the user and so as to be opened automatically by an opening/closing mechanism (not shown) in the case where recording is to be executed while the paper discharge port cover 5 is closed.

In FIG. 2, reference numeral 11 indicates a paper cassette, serving as a recording medium holding unit, in which a plurality of sheets of recording paper (single sheets of paper; referred to as "paper P" hereinafter) can be held (set) in a stacked state. As shown in FIG. 2, this paper cassette 11 is configured so as to be removable from the housing 2; and as shown in FIG. 1, by mounting the paper cassette 11, the exterior of the ink jet printer 1 is configured, whereas by removing the paper cassette 11, the paper transport path within the apparatus is exposed, which makes it possible to carry out processes for eliminating paper jams and the like.

Generally speaking, the paper cassette 11 is, as shown in FIGS. 7 and 8, configured so as to include a tray-shaped main cassette unit 12, an upper outside cover 15 that can be opened/closed, and a mobile tray 23 that can be pivoted. The upper outside cover 15 can take on the closed state illustrated in FIG. 7 and the open state illustrated in FIG. 8 by pivoting central to a pivot support point 15*a* provided in approximately the center of the main cassette unit 12. When the upper outside cover 15 is open, a paper holding space in the main cassette unit 12 appears, as shown in FIG. 8, which makes it possible to set the paper P.

When the paper cassette 11 is in a mounted state, the upper side of the cassette (that is, the left side in FIGS. 7 and 8) is configured so as to be extendable/retractable to accommodate the size of the paper; specifically, an upper sliding tray 18 is provided so as to be capable of sliding relative to the main cassette unit 12 in the paper transport direction (that is, the vertical direction when the cassette is in a mounted state).

Likewise, an upper inside cover 16 is provided so as to be capable of sliding relative to the upper outside cover 15 in the paper transport direction; thus by sliding the upper sliding tray 18 and the upper inside cover 16 in accordance with the paper size, a paper holding space that corresponds to the paper size can be formed (this is the state illustrated in FIGS. 5 and 6).

Next, an edge guide 21 is provided in the main cassette unit 12 so as to be capable of sliding in the paper width direction, and the edge of the paper P that has been set is guided by this edge guide 21 at a position that corresponds to the size of the paper. Note that a long hole 15*b* is formed in the upper outside cover 15 so as to extend in the direction in which the edge guide 21 is displaced, and part of the edge guide 21 can protrude from this long hole 15*b* toward the outside of the upper outside cover 15 (FIG. 7).

A tab portion 21*b* is connected to part of the edge guide 21 that protrudes to the outside of the upper outside cover 15, and the edge guide 21 can be slid using the tab portion 21*b* even if the upper outside cover 15 is in a closed state. In other words, in the case where, after the upper outside cover 15 has been closed, it has been determined that the edge guide 21 is not in a position that can appropriately guide the edge of the paper, the edge guide 21 can be manipulated even without opening the upper outside cover 15.

Next, the mobile tray 23 is provided in a lower area of the cassette when the paper cassette 11 is mounted (that is, the right side in FIGS. 7 and 8), or in other words, on the side that corresponds to the leading edge of the paper. The mobile tray 23 functions as a so-called hopper; specifically, the mobile tray 23 is provided so as to pivot central to a pivot support point 23*a*, and by pivoting, can take on a state in which the leading edge of the paper P that is held therein is pressurized by supply rollers 37 (mentioned later) (FIG. 6) or a state in which the supply rollers 37 are separated from the paper P (FIG. 4).

A plurality of openings 24*a* are formed in the mobile tray 23, in a position that corresponds to the leading edge of the paper, at appropriate intervals along the paper width direction, and the supply rollers 37 can pressurize the paper P held in the mobile tray 23 through these openings 24*a*. Note that reference numeral 12*c* indicates a paper leading edge support partition, configured by the main cassette unit 12, that supports the leading edge of the paper. The paper P that is held when the paper cassette 11 is in a mounted state has its leading edge supported in a state in which the leading edge makes contact with the paper leading edge support partition 12*c*.

Continuing on, the internal configuration of the ink jet printer 1, and specifically the paper transport path, will be described with reference to FIGS. 4 through 6. The supply rollers 37, serving as "inverting rollers", are provided in positions that oppose the leading edge of the paper cassette 11, configured as described above, when the paper cassette 11 is in a vertically-mounted state. The supply rollers 37 are disposed in multiple, on a drive shaft 37*a* that extends in the paper width direction, with an appropriate interval provided therebetween in the paper width direction (FIG. 2); the supply rollers 37 are driven by a motor (not shown), and feed the paper P downstream by rotating while making contact with the leading edge of the paper.

The paper P, which has been fed downward by the supply rollers 37, is inverted upwards by the supply rollers 37 and guide members 40 and 41 that are disposed so as to face the outer circumferential surfaces of the guide rollers 37, and is sent between a transport driving roller 46, serving as a "transport roller", and transport slave rollers (these rollers configure a paper transport unit). In other words, an approximately U-shaped transport path that bends and inverts the paper P is formed by an inverting path unit, which is in turn configured so as to include the supply rollers 37 and the guide members 40 and 41. Note that reference numeral 38 indicates a slave roller that assists in the supply of the paper P by the supply rollers 37.

Rather than the paper P only being fed downward by the supply rollers 37 as mentioned above, this transport path may be a transport path in which the paper P is first fed in the y direction by the supply rollers 37 and is then inverted upwards. Specifically, referring to FIG. 4, a transport path in which the paper P makes contact with the supply rollers 37 at its lowermost edge in the z direction and is then transported upward can be considered.

The transport driving roller 46 is a roller that is rotationally driven by a motor (not shown); in this embodiment, the transport driving roller 46 is configured by abrasion-resistant particles being bonded to the surface of a metal shaft that extends in the paper width direction, and is, among the constituent elements of the ink jet printer 1, a heavy object.

The transport slave rollers 47, in this embodiment, are rollers formed of a resin material; a plurality of transport slave rollers 47 are provided along the axial direction of the transport driving roller 46 at appropriate intervals, and are provided so as to be biased toward the transport driving roller 46 by the biasing force of a biasing unit (not shown). The transport slave rollers 47 undergo slave rotation when the paper P is pinched between the transport driving roller 46 and the transport slave rollers 47.

An ink jet recording head 59 and a guide member 48 are provided so as to oppose each other, downstream from the transport driving roller 46. The ink jet recording head 59 is provided in a carriage 58; the carriage 58, meanwhile, is configured so as to move back and forth in the paper width direction under the force of a motor (not shown) while being guided along a carriage guide shaft 55 that extends in the paper width direction.

Note that with respect to the carriage 58, reference numeral 58*a* indicates a guided portion that encloses a carriage guide plate 56, which in turn is formed so as to extend in the paper width direction. In other words, although the carriage 58 includes a bearing portion through which the carriage guide shaft 55 passes, the carriage 58 is provided at a tilted attitude, as shown in FIG. 4, and there is thus a tendency for the carriage 58 to pivot central to the carriage guide shaft 55; however, because the guided portion 58*a* is configured so as to enclose the carriage guide plate 56, the configuration is such that the stated tendency to pivot is stopped and the attitude of the carriage 58 is set.

Note that as described above, in this embodiment, the ink cartridges 6 are provided in the apparatus itself; in other words, the apparatus is configured as what is known as an off-carriage type, in which the ink cartridges 6 are provided independent from the carriage 58. However, the invention is not limited thereto, and the apparatus may be what is known as an on-carriage type, in which the ink cartridges 6 are mounted in the carriage 58. In addition, although this embodiment describes a configuration in which recording is carried out while the carriage 58 moves in the paper width direction (that is, a serial printer configuration), a fixed-type recording head that covers the width of the paper and in which the carriage 58 does not move in the paper width direction may be used. Furthermore, the invention is not limited to the ink jet recording technique, and other recording techniques may be used instead.

Continuing on, the guide member 48 that is disposed opposite to the ink jet recording head 59 is formed of a resin material, and by supporting the paper P, defines a gap between the recording surface of the paper P and the ink jet recording head 59. In addition, a recess (not shown) that receives ink ejected in regions outside of the edges of the paper during borderless printing is formed in the surface of the guide member 48 that opposes the ink jet recording head 59; furthermore, an ink absorption member (not shown) that absorbs ink is provided within this recess. Further still, a waste liquid tank (not shown) that holds the discarded ink is disposed below the guide member 48.

A guide roller 49 provided downstream from the ink jet recording head 59 prevents the paper P from lifting off from the guide member 48; meanwhile, a recording medium discharge unit, which is provided downstream from the guide roller 49 and includes discharge driving rollers 51 and a discharge slave roller 52, discharges the paper P that has been recorded onto to the exterior of the apparatus. Note that in this embodiment, the discharge driving rollers 51 are configured of rubber rollers; a plurality of discharge driving rollers 51 are provided, at appropriate intervals, along the axis direction of a metal shaft that extends in the paper width direction, and are rotationally driven by a motor (not shown). Meanwhile, the guide roller 49 and the discharge slave roller 52 are configured of toothed rollers that have teeth along their outer circumferences, and undergo slave rotation upon coming into contact with the paper P.

In this embodiment, the direction in which the paper P is discharged by the discharge driving rollers 51 and the discharge slave roller 52 is set to an upward-diagonal direction toward the paper cassette 11; accordingly, the discharged paper P is discharged toward the top of the apparatus while sliding along the upper outside cover 15 of which the paper cassette 11 is partially configured, as shown in FIG. 6. Note that the broken line in FIG. 6 indicates the trajectory of the paper P that is transported along the paper transport path.

A downstream-side path unit is configured of the transport driving roller 46, the transport slave rollers 47, the guide member 48, the ink jet recording head 59, the guide roller 49, the discharge driving rollers 51, and the discharge slave roller 52. A downstream-side path that is positioned downstream from the inverting path unit in the transport path of the paper P is formed by the downstream-side path unit. Specifically, the downstream-side path is formed so as to pass through the position at which the paper P is pinched between the transport driving roller 46 and the transport slave rollers 47, between the surface of the guide member 48 that faces the ink jet recording head 59 and the surface of the ink jet recording head 59 that ejects ink, the position in the external circumference of the guide roller 49 that faces the guide member 48, and the position at which the paper P is pinched between the discharge driving rollers 51 and the discharge slave roller 52.

2. Measures for Preventing Apparatus from Tipping Over

Next, measures for preventing the ink jet printer 1 from tipping over will be described.

The ink jet printer 1 configured as described above is, as mentioned earlier, configured as a standing type, and therefore, by nature, is susceptible to tipping over when installed. Accordingly, with the ink jet printer 1 according to this embodiment, the transport driving roller 46, which is formed of a shaft member that extends in the x direction (that is, the direction orthogonal to the paper transport direction) and which transports the paper P by rotating, and the ink jet recording head 59 are disposed in the central region of the y direction dimension (that is, the depth (thickness) direction of the apparatus).

To be more specific, the letter D in FIG. 4 indicates the y direction dimension, and the letter C indicates the region in the y direction and is occupied by the transport driving roller 46 and the ink jet recording head 59. Furthermore, the letters A and B indicate distances, in the y direction, from the outer surfaces of the apparatus to the occupied region C. In the embodiment, the configuration is such that the distances A and B are not in a strict 1:1 relationship, and the ratio is instead (1):(0.7-1.3) when one of those distances is taken as a reference; the distances are set so that the aforementioned elements are positioned in the central region in the y direction dimension D.

In this manner, according to the ink jet printer 1 of this embodiment, the transport driving roller 46 and the ink jet recording head 59, which are heavy objects, are disposed in the central region of the y direction (that is, the depth (thickness) direction of the apparatus), which is the dimension direction in which the apparatus is susceptible to tipping over; accordingly, it is possible for the apparatus to maintain its balance, and therefore possible to configure a standing-type ink jet printer that is difficult to tip over.

Furthermore, in this embodiment, the supply rollers 37, which serve as inverting rollers for inverting the paper transport direction, are also disposed in the central region of the y direction (that is, the depth (thickness) direction of the apparatus) dimension, in addition to the transport driving roller 46 and the ink jet recording head 59. In other words, in this embodiment, the supply rollers 37, which have a large diameter, are heavy objects in the same manner as the transport driving roller 46 and the ink jet recording head 59, and thus disposing the supply rollers 37, which are such heavy objects, in the central region of the y direction dimension makes it possible to configure a standing-type ink jet printer that is even more difficult to tip over.

Although in this embodiment, the transport driving roller 46, the ink jet recording head 59, and the supply rollers 37 are disposed in the central region of the y direction (that is, the depth (thickness) direction of the apparatus) dimension as described above, it should be noted that the invention is not limited thereto; if other heavy objects are present as well, such objects can also be disposed in the central region, which makes it possible to configure a standing-type ink jet printer that is even more difficult to tip over. In addition to the rotation shaft of the discharge driving rollers 51, the constituent elements of the paper transport path, and so on, the carriage guide shaft 55, a power supply unit (not shown), and so on can be given as examples of such heavy objects.

Although in this embodiment, the transport driving roller 46, the ink jet recording head 59, and the supply rollers 37 have been described as all being disposed in the central region of the y direction (that is, the depth (thickness) direction of the apparatus) dimension, it is also possible to dispose as objects of only one or two of these elements in the central region.

Furthermore, by employing a configuration such as that described above, the center of gravity G of the apparatus as a whole can be set to the central region of the y direction (that is, the depth (thickness) direction of the apparatus) dimension, which makes it possible to configure a standing-type ink jet printer that is difficult to tip over.

Further still, setting the center of gravity G to be lower than the central position of the z direction (that is, the height direction of the apparatus) makes it possible to configure a standing-type ink jet printer that is even more difficult to tip over. In this embodiment, as illustrated clearly in FIG. 4, the transport driving roller 46, the ink jet recording head 59, and the supply rollers 37 are disposed lower than the central position in the z direction (that is, the height direction of the apparatus); therefore, the center of gravity G of the apparatus as a whole is set to be lower than the central position in the z direction (that is, the height direction of the apparatus), thus configuring a standing-type ink jet printer that is even more difficult to tip over.

In addition, in this embodiment, the paper cassette 11 is disposed on one end in the y direction (that is, the depth (thickness) direction of the apparatus) dimension. There are cases where the center of gravity G of the apparatus as a whole will move greatly in the y direction, such as when the maximum number of sheets of paper is held and when the minimum number of sheets of paper is held, which affects how susceptible the apparatus is to tipping over; however, if the disposition, weight, and so on of the heavy objects are set so that the center of gravity G of the apparatus as a whole falls within, for example, the region C shown in FIG. 4, it is possible to configure a standing-type ink jet printer that is even more difficult to tip over, regardless of the number of sheets of paper that are held.

3. Location of Recording Head in Transport Path

Next, the location at which the ink jet recording head 59 is disposed in the paper transport path will be described.

As described above, the ink jet printer 1 according to this embodiment includes an approximately U-shaped paper transport path that, using the inverting path unit formed of the supply rollers 37 and the guide members 40 and 41 on the outsides thereof, inverts the transport direction and transports, toward the top of the apparatus, the paper P that has been supplied toward the bottom of the apparatus from the paper cassette 11; a recording unit that is configured including the ink jet recording head 59 is provided downstream from the inverting path unit.

Here, if the ink jet recording head 59 is provided upstream from the inverting path unit or partway along the inverting path unit, it is necessary to strongly bend the paper after recording has finished, and there is thus a risk of causing a drop in the recording quality. Paper on which ink jet recording has been carried out is particularly likely to have waves (cockling) formed in the paper width direction, and if the paper is bent and inverted in such a state, there is the risk that the waves will be crushed, leading to the occurrence of wrinkles.

However, with the ink jet printer 1 according to this embodiment, the ink jet recording head 59 is provided downstream from the inverting path unit, as described earlier, and therefore the paper P that has been recorded onto is not bent in the approximately U-shaped bending inversion path, which makes it possible to obtain the desired appropriate recording result.

Although in this embodiment, the paper transport path downstream from the inverting path unit formed by the supply rollers 37 is tilted (an angle $\alpha$ shown in FIG. 4; for example, 12°), it should be noted that the invention is not limited thereto; for example, the area downstream from the inverting path unit formed by the supply rollers 37 may, as shown in FIG. 9A, follow the vertical direction (in other words, the angle $\alpha$ shown in FIG. 4 may be 0°).

In addition, in this embodiment, the ink jet recording head 59 is provided in a position that opposes the outside of the approximately U-shaped paper transport path, or in other words, the surface that is on the outside when the paper is bent and inverted. Accordingly, the paper is significantly exposed in the transport path, which makes it easy to eliminate paper jams in the case where such paper jams have occurred.

However, as shown in FIG. 9B, it is also possible to provide the ink jet recording head 59 in a position that opposes the inside of the approximately U-shaped paper transport path, or in other words, the surface that is on the inside when the paper is bent and inverted. Because the supply rollers 37 are provided in the recording apparatus as the inverting rollers, and there is space above the supply rollers 37, the ink jet recording head 59 can be provided in this space; as a result, it is not necessary to secure a large space for providing the ink jet recording head 59, the carriage 58, and so on outside of the paper transport path, which in turn makes it possible to reduce the size of the apparatus.

4. Form of Paper Transport Path

Next, the form of the paper transport path in the ink jet printer 1 will be described in further detail. As shown in FIG. 4, the paper transport path of the ink jet printer 1 according to this embodiment is an approximately U-shaped transport path that supplies the paper P from the paper cassette 11 toward the bottom of the apparatus, which has been set along the vertical direction, inverts the transport direction through the inverting path unit formed by the supply rollers 37, and then transports the paper P toward the top of the apparatus; after the transport direction has been switched from downward to upward by the inverting path unit formed by the supply rollers 37, the downstream-side path formed by the downstream-side path unit mentioned earlier is tilted toward the paper cassette 11.

The angle $\alpha$ shown in FIG. 4 indicates the angle of the slope, and is set to a range of $0° < \alpha < 90°$; in this embodiment, $\alpha$ is set to 12° as an example. In this manner, the path after the transport direction has been switched from downward to upward by the supply rollers 37 is tilted toward the paper cassette 11, thus forming an empty space above the downstream-side path; by disposing the ink jet recording head 59 and the carriage 58 in this empty space, an increase in the thickness direction dimension (that is, the y direction dimension) of the apparatus can be avoided.

Furthermore, because the paper transport path is tilted, the paper P does not flop over when the paper P is discharged upward, which makes it possible to stabilize the attitude of the paper P. Although in this embodiment, the ink jet recording head 59 is disposed in the tilted path with its head surface in a tilted state and the guide member 48 is disposed with its paper guide surface (that is, the surface that opposes the recording head) in a tilted state, it should be noted that these elements do not necessarily need to be provided in the tilted path, and may be provided therebefore or thereafter, in, for example, a vertical path, a horizontal path, or the like.

In addition, in this embodiment, the paper discharge direction implemented by the discharge driving rollers 51 and the discharge slave roller 52 that configure the recording medium discharge unit proceeds toward the paper cassette 11, and accordingly, the discharged paper P is, as shown in FIG. 6, discharged while sliding along the paper cassette 11 (specifically, along the upper outside cover 15 or the upper outside cover 15 and the upper inside cover 16, in this embodiment).

Accordingly, the attitude of the discharged paper P is further stabilized. In addition, the discharged paper P pushes against the paper P that has already been discharged, and thus the paper P that has already been discharged retains its alignment and is neatly stacked. Furthermore, because part of the paper cassette 11 can be used as a stacker, it is possible to reduce the number of components, which in turn achieves a reduction in the size and the cost of the apparatus.

Note that in this embodiment, as a result of the paper discharge direction proceeding toward the paper cassette 11 as described earlier, the paper cassette 11 and the paper discharge port 4 are disposed in a position that is apart from the central position in the thickness direction (the y direction) of the apparatus. Accordingly, it is possible to secure continuous space that is comparatively wide in the top surface of the apparatus, which makes it possible to increase the freedom with which the apparatus can be laid out. For example, in the case where the operation panel 3, which is configured of operation switches and the like, is disposed on the top surface of the apparatus, as in the present embodiment, a higher degree of freedom can be ensured for the design thereof.

The embodiment described thus far is merely one example, and it goes without saying that the invention is not limited thereto. For example, although the aforementioned embodiment applies the invention to an ink jet printer serving as an example of a recording apparatus, it is also possible to apply the invention to liquid ejecting apparatuses in general.

Here, a "liquid ejecting apparatus" is not limited to recording apparatuses such as printers, copy machines, facsimile devices, and the like that record onto a recording medium by using an ink jet recording head to eject ink from the recording head, and also includes apparatuses that eject, from a liquid ejecting head that corresponds to the aforementioned ink jet recording head, a liquid that is not ink but that corresponds to such an application, onto an ejection medium that corresponds to the recording medium, thus causing the liquid to adhere to the ejection medium.

In addition to the aforementioned recording heads, a color material ejecting head used in the manufacture of color filters for liquid crystal displays and the like, an electrode material (conductive paste) ejecting head used in the formation of electrodes for organic EL displays, surface emission displays (FEDs) and the like, a bioorganic material ejecting head used in the manufacture of biochips, a test material ejecting head serving as a precision pipette, and so on can be given as examples of liquid ejecting heads.

The entire disclosure of Japanese Patent Applications No:2010-225040, filed Oct. 4, 2010 and No:2010-225027, filed Oct. 4, 2010 are expressly incorporated by reference herein.

What is claimed is:

1. A recording apparatus comprising:

a recording head that records onto a recording medium;

a recording medium holding unit that holds the recording medium in alignment with the vertical direction;

an inverting path unit that inverts a transport direction of the recording medium fed out from the recording medium holding unit;

a downstream-side path unit that transports the recording medium from the inverting path unit toward the recording medium holding unit; and a recording medium discharge unit, provided downstream from the recording head in the downstream-side path unit, that discharges the recording medium to the exterior of the apparatus, wherein the recording medium is discharged by the recording medium discharge unit while sliding along the recording medium holding unit.

2. The recording apparatus according to claim 1, wherein the recording apparatus is configured so that, when the recording apparatus is installed, the height direction dimension of the recording apparatus is greater than at least one of the horizontal width direction dimension and the depth direction dimension of the recording apparatus, and the depth direction is smaller than the horizontal width direction dimension;

the recording apparatus further includes a discharge port for discharging the recording medium discharged by the recording medium discharge unit to the exterior of the recording apparatus; and the recording medium holding unit and the discharge port are disposed in a position that is apart from the central location in the depth direction.

3. The recording apparatus according to claim 1, wherein the inverting path unit switches the transport direction of the recording medium to an upward direction; and at least part of a downstream-side path formed by the downstream-side path unit is tilted toward the recording medium holding unit.

4. The recording apparatus according to claim 3, wherein a guide member that forms the downstream-side path is formed;

the guide member includes a guide surface that guides the recording medium downstream;

at least part of the guide surface tilts toward the recording medium holding unit; and the surface of the recording head that records onto the recording medium is provided so as to be aligned with the tilted guide surface.

5. The recording apparatus according to claim 3, wherein the height direction dimension of the recording apparatus when the recording apparatus is installed is greater than at least one of the horizontal width direction dimension and the depth direction dimension of the recording apparatus.

6. The recording apparatus according to claim 1, wherein the recording medium discharge unit comprises a discharge port through which the recording medium is discharged, the discharge port being provided in an upper surface of the recording apparatus.

7. The recording apparatus according to claim 6, wherein the recording medium discharge unit comprises a discharge port cover configured to open and close the discharge port.

* * * * *